US006929167B2

(12) United States Patent
Pong et al.

(10) Patent No.: US 6,929,167 B2
(45) Date of Patent: Aug. 16, 2005

(54) CONTROL OF HOT ROLLED PRODUCT CROSS SECTION UNDER LOCALIZED TEMPERATURE DISTURBANCES

(75) Inventors: David Teng Pong, Shiu Wing Steel Limited, Room 3409, 34/F Jardine House 1 Connaught Place, Central, Hong Kong SAR (CN); Thomas George Maylor, HKSAR (CN); Erik Mats Raftsjö, HKSAR (CN)

(73) Assignee: David Teng Pong, Hong Kong (CN)

( * ) Notice: Subject to any disclaimer, the term of this patent is extended or adjusted under 35 U.S.C. 154(b) by 0 days.

(21) Appl. No.: 10/690,166

(22) Filed: Oct. 21, 2003

(65) Prior Publication Data

US 2005/0082344 A1 Apr. 21, 2005

(51) Int. Cl.[7] ..... B23K 31/00
(52) U.S. Cl. ..... 228/102; 228/5.7
(58) Field of Search ..... 228/102, 173.1, 228/173.2, 173.3, 173.6, 235.2, 235.3, 5.7, 17, 17.5, 17.7, 49.1, 49.4; 219/612, 617, 57, 58, 81–83, 158–159

(56) References Cited

U.S. PATENT DOCUMENTS 5,292,052 A * 3/1994 Ito et al. ..... 228/158
5,804,790 A * 9/1998 Takashima ..... 219/117.1
5,871,138 A * 2/1999 Shishido et al. ..... 228/102
5,957,367 A * 9/1999 Matsuo et al. ..... 228/158
6,089,441 A * 7/2000 Matsuo et al. ..... 228/125

FOREIGN PATENT DOCUMENTS

JP 360206505 A * 10/1985
JP 404089112 A * 3/1992

* cited by examiner

*Primary Examiner*—Kiley S. Stoner
(74) *Attorney, Agent, or Firm*—Ladas and Parry LLP

(57) ABSTRACT

A method of rolling a continuous welded billet having weld joints at successive locations along the billet and wherein the continuous welded billet is advanced through roll pairs of successive roll stands. The rolling conditions in two successive stands are adjusted so that when a weld joint is between the two stands compression is produced at the weld joint causing an increase of cross-sectional area at the weld joint. The rolling condition involves superimposing an increase in roll speed in the upstream roll stand compared to the downstream roll stand based on tracking information of the weld joint.

16 Claims, 3 Drawing Sheets

CONTROL OF HOT ROLLED PRODUCT CROSS SECTION UNDER LOCALIZED TEMPERATURE DISTURBANCES

FIELD OF THE INVENTION

The invention relates to a method of controlling the rolling of a continuous welded billet having weld joints at successive locations along the billet.

BACKGROUND OF THE INVENTION

Traditional mill control and operation has been acceptable for the rolling of single billets, but with the advent of the new technology of continuously welded billets, control strategies and operations have to be rethought to obtain the full benefits of the process. These benefits include increased yield and productivity, reduced cobbles and more consistent tolerances. However, the welding process raises the joint temperature above the remainder of the billet and produces a small region that is softer and less resistant to rolling forces. This high temperature can produce excessive dimensional change at the welded joint outside of the specified tolerance for the product and is unacceptable.

The behavior of the rolled material through a roll pass in hot rolling is governed by many factors. The most variable of these factors is the temperature of the material. Higher temperature material has a tendency to elongate more during rolling while colder material will spread more. The change in elongation and spread results in a variation in product exit speed.

In continuous rolling mills, the material can be present in many pairs of rolls at the same time and the relative speeds of the roll pairs must be balanced to avoid either accumulation of material between stands of the roll pairs or tension in the material.]

In so-called roughing stands, automatic tension control is set solely on the conditions at the head of the billet. Any deviation of temperature between the head of the billet and the remainder of the billet will result in an incorrect speed setting. A cold head can result in an accumulation of material between the stands and a hot head in tension in the material.

The accumulation of material between stands is an unstable and hazardous condition and operators normally set the relative speeds to avoid this condition and thus carry out rolling with tension in the roughing stands. It is this tension that is the cause of the dimensional change in the welded joint.

Control can be continuously applied for material of small cross-section by the use of loopers in the intermediate and finishing stands. Loopers control the relative roll speeds in the stands by measuring the displacement of a loop of material formed between adjacent stands. Arising loop increases the speed differential, and a falling loop decreases the differential by adjusting the upstream stand. The transient effect of the weld joint is to briefly raise the loop height but only after the weld has passed the stand. The speed control is thus applied to the wrong part of the material.

SUMMARY OF THE INVENTION

It is an object of this invention to provide a method to eliminate the tension in the welded portion of the material and furthermore induce compression in the billet to correct the dimensional variation created upstream and downstream of the stands.

In accordance with the invention, the speed of the rollers in roller stands are adjusted in response to the presence of a weld joint in the billet to produce compression in the billet at the weld joint downstream of the rollers and upstream of the next downstream stand to produce compression in the billet at the weld joint and build-up of material thereat.

The method of the invention tracks the weld through the roughing stands and applies control of compression of the material at variable levels and time periods to suit the material and welding conditions and the performance is monitored downstream using suitable measuring instruments.

The invention can also be applied to other detectable transient disturbances in the rolled material.

DETAILED DESCRIPTION OF THE INVENTION

Figure 1:
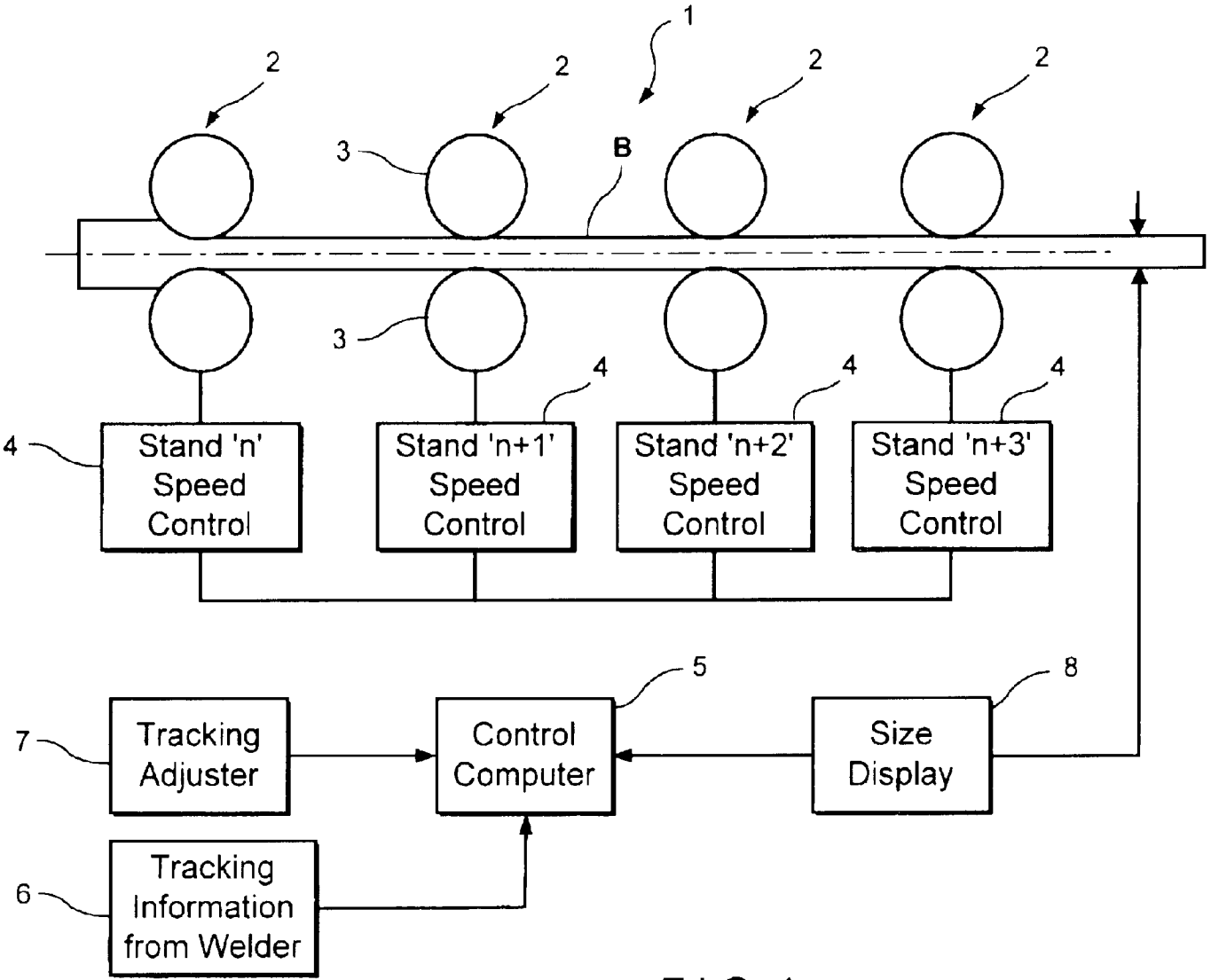
FIG. 1 diagrammatically illustrates apparatus for rolling a billet through successive stands of a mill.

Referring to FIG. 1 of the drawing, therein is seen a rolling mill 1 having a succession of stands 2 for rolling a billet B. Each of the stands 2 includes rolls 3 which act on the billet to produce a finished rolled product.

The speed of the rolls 3 in each stand is controlled by a respective speed control device 4 under the control of a computer 5.

In accordance with the invention, the billet is a continuous welded billet and the welds in the billet are tracked by information supplied from a sensor 6 associated with a welder (not shown) that produces the welds. A tracking adjuster 7 is connected to the computer 5 to provide speed adjustment of the rolls in the stands to eliminate irregularities produced in the billet at the welds. The size of the billet as it exits from the last stand 2 shown in FIG. 1 is measured and shown on a display 8 and the size information is fed to the computer 5.

Existing mill control systems use a control feedback method to adjust the mill speeds to correct measured errors in variables that reflect the degree of tension or mismatch between stand speeds. The measurements are taken after the rolling process and adjustments are applied to all following material.

Detection of errors is made on the material after the material has passed through the stand by a distance equal to between one-half and the full distance to the next downstream stand. Any transient error at less than half the distance between stands will not be corrected and could induce adverse speed changes in the following material. The existing mill control system can not respond to the new billet welding process in which hot spots of 1½-second duration are developed.

It was foreseen that identification and tracking of a known transient error to the roll stand would enable appropriate adjustment to be made to correct the transient error alone while not disturbing the remainder of the rolled material.

Measurements show that the transient error induced by the high temperature at the weld was consistent for each rolling setup and the dimensional error was evident from the roughing stands onward through the rolling process to the finished product.

The invention is based on the application of compression to the material during rolling to relieve tension which causes reduced size and to induce size increase from the compression to send oversize material to the downstream stands.

Figure 2A:
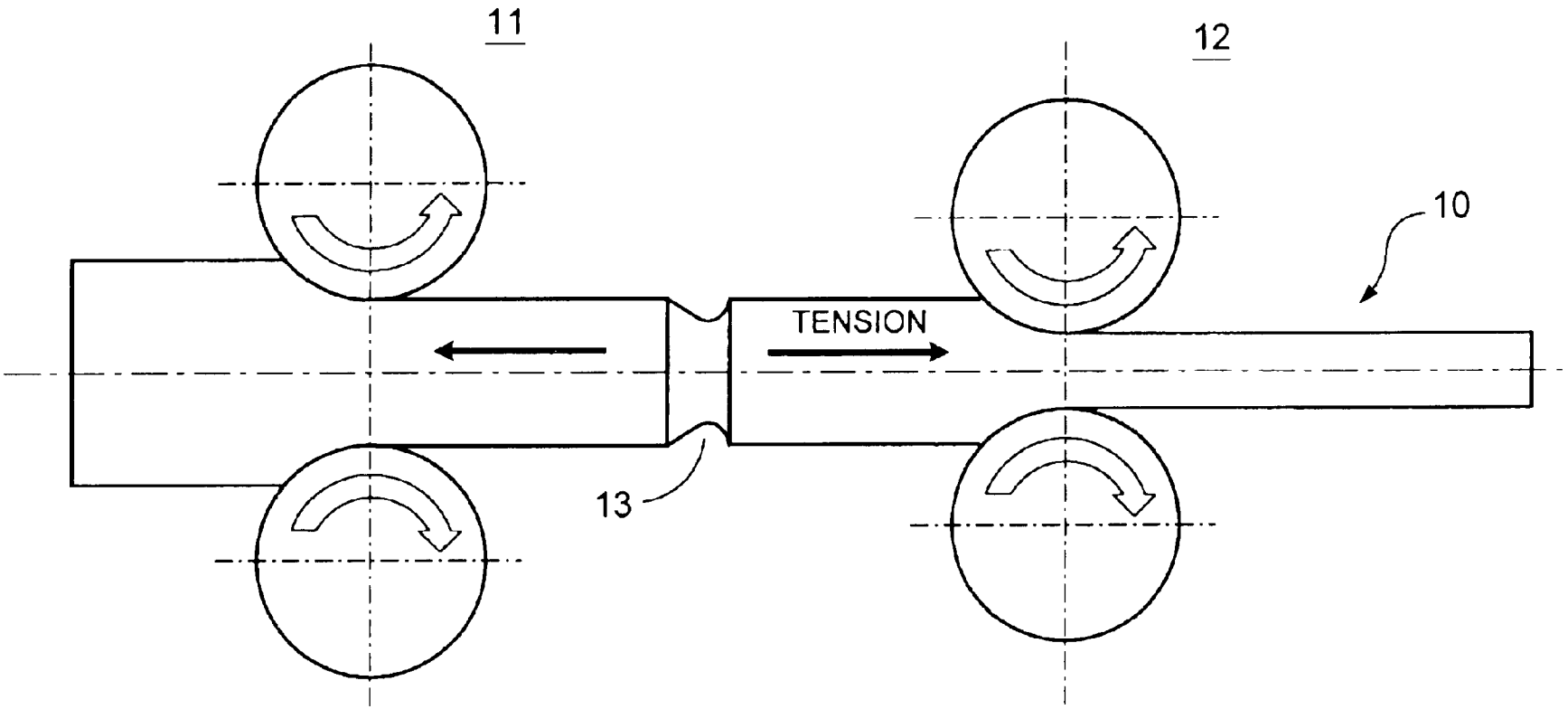
FIG. 2A PRIOR ART
FIG. 2A is a diagrammatic illustration of rolling a billet with a welded joint between successive stands according to the known art.

FIG. 2A shows a typical arrangement according to the prior art when a billet 10 is advanced between stands 11 and 12 and when the billet has a weld joint 13.

Under normal conditions of speed control, due to the increased temperature at the weld joint 13 the tension produced in the billet between stands 11 and 12 will produce a neck-down or reduced size of the billet at the weld joint 13. This leads to dimensional changes in the billet and the welded joint after rolling which is outside of specified tolerance for the product and renders the product unacceptable.

Figure 2B:
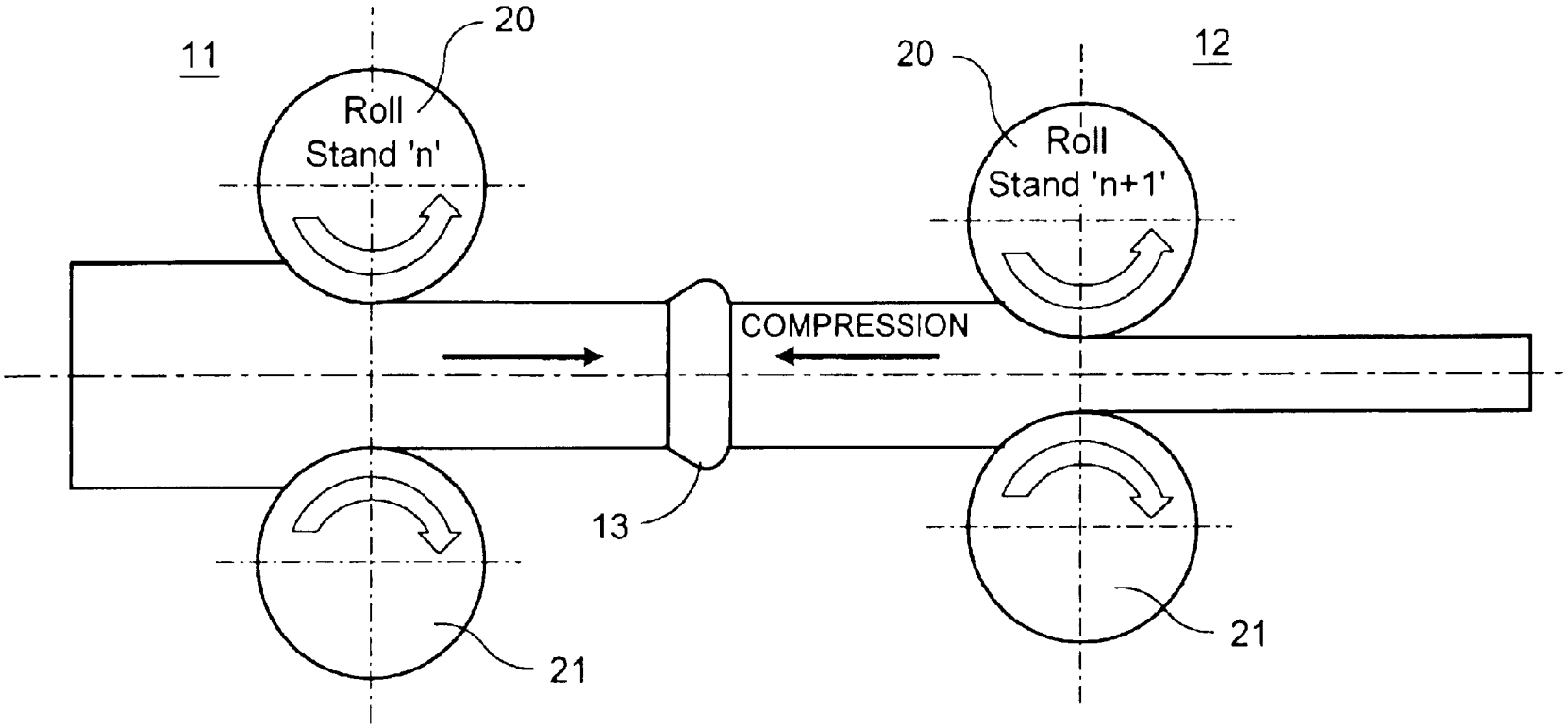
FIG. 2B is similar to FIG. 2A showing the effect of the method of the invention.

Referring to FIG. 2B, the rolls 20 and 21 of the stands 11 and 12 are regulated by the computer 5 to superimpose a speed change on the rolls in order to produce a compression in the billet in the zone between the stands 11 and 12 and thereby produce a build-up of material at the weld joint 13. By superimposing the speed control on the rolls not only is the tension in the weld joint removed but additionally the increase in dimension at the weld joint prepares the material for the subsequent rolling in the downstream stands. The stiffness of the billet between stands diminishes as the rolling of the billet proceeds and therefore the main change in the speed adjustment of the rolls takes place at the entry end of the mill in the roughing stage. The speed control diminishes along the travel of the billet until it is no longer practical at the downstream end.

Conventional loopers controlling the speed at the downstream end respond to the speed increase due to the weld passage by slowing the stand after the weld has passed. By freezing the control for the period of passage of the weld joint this unnecessary adjustment is eliminated and the dimensions after the joint are stabilized while also reducing mechanical wear on the drive components.

The principle of feeding forward information on the temperature can be applied to other deviations in a product that can be sensed and corrected by speed changes in the mill rolling stands.

The method can be applied to correct dimensional variations arising from uneven heating in a furnace by modifying the stand speed from the measured temperature upstream of the stand. The invention can also be employed to control dimensional variation arising from chilled skid marks of a walking beam furnace.

In a typical rolling process of billets with welded joints, the billets pass through a number of roll stands in the mill. The computer regulates the roll speed in the stands according to the size of the billet at the entry of the rolling stage and the desired size at the end of the rolling stage. When a weld joint is detected in the billet based on tracking information in the welder, this information is supplied to the computer which regulates roll speed. The computer adjusts the speed of the roll at the various stands to produce compression in the billet at the weld joints in order to compensate for any neck down at the weld joint due to tension at the weld joint while the weld joint is still at an elevated temperature. Because the weld joints are at their highest temperature when they leave the welder and section stiffness is highest when entering the roughing stage of rolling, the speed increase of the rollers will be highest in the stands of the roughing stage and the speed increase gradually diminishes as the rolling progresses downstream and the temperature differential between the welded joints and the rest of the billet diminishes.

By way of example, a billet with a 125 mm square section is introduced into a rolling mill having 15 stages in which the size of the billet is reduced to produce rolled rod of a diameter of 25 mm. The temperature of the billet upon entry into the rolling mill is 1000° C. and the billet is supplied at a speed of 0.2 meters/min. The billet has weld joints spaced at a distance of about 12 meters and is a continuous welded billet. The welded joints are at a temperature of 200° C. above the rest of the billet. In order to compensate for the temperature increase at the welded joints, the speed of the rolls in the stands of the mill are increased in order to produce a uniform rolled rod. The speed increase is maximum at the first roughing stands of the mill and gradually diminishes as the section stiffness reduces. The speed increase is shown Table 1 hereafter as a function of the position of the stand in the rolling mill.

Example of speed increase (including conceding to upstream stands)

126×125 mm×12 meter billet

| | Weld before stand 1 | Weld between stand 1–2 | Weld between stand 2–3 | Weld between stand 3–4 | Weld between stand 4–5 | Weld between stand 5–6 | Weld after stand 6 |
|---|---|---|---|---|---|---|---|
| Stand 1 speed Increase | | 1.20% | 1.10% | 1.20% | 0.90% | 0.50% | |
| Stand 2 speed Increase | | | 1.10% | 1.20% | 0.90% | 0.50% | |
| Stand 3 speed Increase | | | | 1.20% | 0.90% | 0.50% | |
| Stand 4 speed Increase | | | | | 0.90% | 0.50% | |
| Stand 5 speed Increase | | | | | | 0.50% | |

The effect of the speed adjustments can be further refined by applying the speed increase for varying weld positions and time periods between stands.

The speed increase to compensate for temperature differential between the welded joints and the rest of the billet is phased out between the $7^{th}$ and $8^{th}$ stands As a result, the rolled billet will have a substantially uniform size and uniform properties at the weld joints of the rolled billet.

There will now be obvious to those skilled in the art, many modifications and variations of the apparatus set forth hereinabove. These modifications and variations will not depart from the scope of the invention as defined by the following claims.

What is claimed is:

1. In a method of rolling a continuous welded billet having weld joints at successive locations along the billet and wherein the continuous welded billet is advanced through roll pairs of successive roll stands, the improvement comprising:

adjusting rolling conditions in two successive stands after a welded joint of a continuous welded billet has passed one stand and is between the two stands to produce compression at said welded joint and an increase of cross-sectional area at said welded joint, wherein the rolling conditions are adjusted by increasing speed of the roll pair of said two stands, wherein the increase of the speed of the roll pair of the other of the two stands is lower than the increased speed of said one stand.

2. The method of claim 1, comprising controlling roll speed at each roll stand by a respective speed controller and connecting all of said speed controllers to a control computer to regulate roll speed at the stands.

3. The method of claim 2, wherein the control computer receives tracking information of welds from a welding means and produces output for control of roll speed based on the tracking of the welds.

4. The method of claim 3, comprising displaying size of the billet and supplying the size of the billet to the control computer.

5. The method of claim 1, wherein the increased speed in the roll stands diminishes as the billet advances through downstream roll stands.

6. In a method of rolling a continuous welded billet having weld joints at successive locations along the billet and wherein the continuous billet is advanced through roll pairs of successive roll stands, the improvement comprising:

adjusting speed of rolls in a roll stand in response to the presence of a weld joint in the billet to produce compression in the billet at the weld joint downstream of the roll stand and upstream of the next downstream roll stand, thereby producing a build-up of material in said weld joint between the stands, controlling speed of the rolls at the roll stands by a control computer, and supplying information to said computer regarding location of weld joints and effecting the adjusting of the speed of the rolls in a roll stand when a weld joint is downstream of one stand and upstream of the next successive stand, wherein in the absence of a weld joint, the computer regulates the speed of the rolls to produce a rolled billet and when a weld joint is detected, the computer causes increase of the speed of the rolls on the stand upstream of the weld joint to produce compression at the weld joint before the weld joint reaches the next downstream roll stand.

7. The method of claim 6, wherein the stands are present in a roughing stage of rolling.

8. The method of claim 6, wherein said adjusting the speed of the rolls and consequent build-up of material at the weld joint prevents any neck-down at the joint.

9. The method of claim 6, wherein the speed of the rolls is increased after a weld joint has passed the upstream stand and before the weld joint reaches the next downstream roll stand.

10. The method of claim 6, wherein the presence of a weld joint is detected based on tracking information from a welder.

11. The method of claim 6, wherein the increase of the speed of the rolls is diminished in downstream roll stands and eventually is phased out.

12. In a method of rolling a continuous welded billet having weld joints at successive locations along the billet and wherein the continuous welded billet is advanced at high temperature from a welder, the weld joints being at a higher temperature than the rest of the billet, the welded billet being advanced through roll pairs of successive roll stands of a rolling mill, the improvement comprising:

adjusting rolling conditions in two successive roll stands, in an upstream region of the roll mill at which the billet and weld joints are at high temperature, said rolling conditions being adjusted such that after a welded joint of the continuous welded billet has passed one stand and is between the two successive stands to produce compression at said welded joint of high temperature and cause bulging of the welded joint to produce an increase of cross-sectional area at said welded joint such that at the end of the rolling mill, the weld joints of the now rolled billet will have uniform size and proportion.

13. The method of claim 12, comprising providing tracking information of the welds from the welder for controlling roll speed of the roll pairs.

14. The method of claim 12, wherein the adjusting of the rolling conditions in the roll stands diminishes as the billet advances to a downstream region of the rolling mill.

15. The method of claim 12, comprising controlling roll speed at each roll stand by respective speed controllers and connecting all of said speed controllers to a control computer to regulate roll speed at the stands.

16. The method of claim 12, comprising increasing the speed of the roll pair of said next downstream roll stand by an amount lower than the increased speed of said one stand.

* * * * *